US008782859B2

(12) United States Patent
Takani

(10) Patent No.: US 8,782,859 B2
(45) Date of Patent: Jul. 22, 2014

(54) CONCEALED SLIDE FASTENER

(75) Inventor: Go Takani, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 13/695,117

(22) PCT Filed: Apr. 28, 2010

(86) PCT No.: PCT/JP2010/057629

§ 371 (c)(1),
(2), (4) Date: Oct. 29, 2012

(87) PCT Pub. No.: WO2011/135706

PCT Pub. Date: Nov. 3, 2011

(65) Prior Publication Data

US 2013/0042442 A1 Feb. 21, 2013

(51) Int. Cl.
*A44B 19/38* (2006.01)

(52) U.S. Cl.
USPC ..... 24/433; 24/432; 24/434

(58) Field of Classification Search
USPC ..... 24/415, 432, 433, 434
See application file for complete search history.

(56) References Cited

U.S. PATENT DOCUMENTS

| | | | | |
|---|---|---|---|---|
| 4,244,087 | A * | 1/1981 | Akashi | 24/433 |
| 6,112,376 | A * | 9/2000 | Akashi et al. | 24/433 |
| 6,195,852 | B1 * | 3/2001 | Kusayama | 24/434 |
| 6,481,068 | B1 | 11/2002 | Takasawa | |
| 6,704,975 | B2 * | 3/2004 | Matsumoto et al. | 24/434 |
| 8,020,261 | B2 * | 9/2011 | Takani et al. | 24/433 |
| 2003/0115725 | A1 | 6/2003 | Matsumoto et al. | |
| 2008/0222855 | A1 | 9/2008 | Takani et al. | |

FOREIGN PATENT DOCUMENTS

| | | | |
|---|---|---|---|
| DE | 3428858 | A1 | 2/1986 |
| JP | 2001-95608 | A | 4/2001 |
| JP | 2003-180411 | A | 7/2003 |
| JP | 2006-000468 | A | 1/2006 |
| JP | 2008-220842 | A | 9/2008 |
| WO | 2010/041303 | A1 | 4/2010 |

OTHER PUBLICATIONS

International Search Report, PCT Application No. PCT/JP2010/057629, mailed Jun. 15, 2010.
Office Action, Japanese Patent Application No. 2012-512598, mailed Nov. 12, 2013.

* cited by examiner

*Primary Examiner* — Robert J Sandy
*Assistant Examiner* — David Upchurch
(74) *Attorney, Agent, or Firm* — Kilpatrick Townsend & Stockton LLP

(57) ABSTRACT

There is provided a concealed slide fastener. The slide fastener includes a pair of fastener tapes, a pair of fastener element rows, a slider, a box pin, a box body and an insert pin. The insert pin includes an insert portion configured to be inserted into a space of the box body and an engagement portion formed on a side surface of the insert portion, which faces the box pin and configured to be engaged with a lowermost one of the fastener elements of one of the fastener element rows which is close to the box pin. The length of the engagement portion is set to be at least twice an interval between the fastener elements.

3 Claims, 14 Drawing Sheets

CONCEALED SLIDE FASTENER

This application is a national stage application of PCT/JP2010/057629 which is incorporated herein by reference.

TECHNICAL FIELD

The present invention relates to a concealed slide fastener, and more particularly, to a separable end stop of a concealed slide fastener.

BACKGROUND ART

A related-art concealed slide fastener includes a pair of fastener tapes, a pair of fastener element rows, a slider, a box pin and a box body, an insert pin. The pair of fastener element rows are respectively provided on bent edges which are formed by bending opposing tape side edges of the pair of fastener tapes along a longitudinal direction thereof into substantially U-shape. Each of the fastener element rows has a plurality of fastener elements. The slider is configured to insert the pair of fastener element rows therethrough and configured to engage and disengaged the pair of fastener element rows with and from each other. The box pin and the box body are provided at one end of one of the pair of fastener tapes in a longitudinal direction of the fastener element rows. The insert pin is provided at one end of another of the pair of fastener tapes in the longitudinal direction of the pair of fastener element rows. The insert pin can be inserted into the box body. An engagement portion configured to be engaged with the lowermost fastener element of the fastener element row which is close to the box pin is formed on a side surface of the insert pin, which faces the box pin. The related-art concealed slide fastener prevents the slide fastener from being opened from a side of a separable end stop (the box pin, the box body and the insert pin) when lateral pulling force is applied to the slide fastener (e.g., refer to Patent Document 1).

PRIOR ART DOCUMENT

Patent Document

Patent Document 1: Japanese Patent Application Publication No. 2001-095608A

SUMMARY OF INVENTION

Problems to be Solved by Invention

In the concealed slide fastener, since fastener tapes and pieces of cloth of a garment are present on the front surface side, it is more difficult to determine the insertion state of the insert pin as compared with the separable end stop of a typical slide fastener. In some cases, the slider is pulled up without inserting the insert pin into a predetermined position. In the concealed slide fastener described in Patent Document 1, if the slider is forcibly pulled up in that state, the engagement portion widens the interval between the fastener elements and enters into the interval. The slide fastener is then closed in this state. However, since the insert pin is not inserted into the predetermined position, the slide fastener which is closed in this state cannot endure the lateral pulling force applied thereto. Therefore, there is a possibility that the slide fastener may be opened while being used. In addition, since the slide fastener is closed by applying an excessive amount of force, there is a possibility that the separable end stop or the fastener element may be broken.

Accordingly, the present invention has been made keeping in mind the above problems occurring in the related art, and an object of the present invention is to provide a concealed slide fastener which can prevent the slider from moving in the closing direction without inserting the insert pin into a predetermined position.

Means for Solving Problems

The object of the present invention is achieved by the following configurations.

(1) A concealed slide fastener comprising: a pair of fastener tapes; a pair of fastener element rows respectively provided on bent edges which are formed by bending opposing tape side edges of the pair of fastener tapes along a longitudinal direction thereof into substantially U-shape, the pair of fastener element rows each having a plurality of continuous fastener elements; a slider configured to insert the pair of fastener element rows therethrough and configured to engage and disengage the pair of fastener element rows with and from each other; a box pin and a box body which are provided at one end of one of the pair of fastener tapes in a longitudinal direction of the pair of fastener element rows; and an insert pin provided at one end of another of the pair of fastener tapes in the longitudinal direction of the pair of fastener element rows, the insert pin being insertable into the box body, wherein the insert pin comprises: an insert portion configured to be inserted into a space formed in the box body; and an engagement portion formed on a side surface of the insert portion, which faces the box bin and configured to be engaged with a lowermost one of the fastener elements of one of the fastener element rows which is close to the box pin, and wherein a length of the engagement portion is set to be at least twice an interval between adjacent two of the fastener elements.

(2) The concealed slide fastener according to (1), wherein a receiving portion configured to receive the engagement portion therein is formed in a side surface of the box pin, which faces the insert pin, wherein a bulged portion having a dimension greater than a dimension of the receiving portion in a width direction is formed on the box pin at a position closer to the box body than the receiving portion, and wherein a base end of the bulged portion is positioned closer to the fastener elements than an end edge of the pair of fastener tapes in a longitudinal direction.

Advantageous Effects of Invention

According to the concealed slide fastener of the present invention, the insert pin includes the insert portion configured to be inserted into the space formed in the box body and the engagement portion formed in the side surface of the insert portion, which faces the box pin. The engagement portion engages with the lowermost fastener element of the fastener element row which is close to the box pin. The length of the engagement portion is set to be at least twice the interval between the fastener elements. Thus, even if the slider is attempted to move in the closing direction in a state in which the insert pin is not inserted into a predetermined position, the engagement portion does not enter between the fastener elements. Therefore, it is possible to prevent the slider from moving in the closing direction. Accordingly, it is possible to prevent undesirable engagement of the fastener elements, thereby improving the reliability of the concealed slide fastener.

In addition, according to the concealed slide fastener of the present invention, the base end of the bulged portion is positioned closer to the fastener element than the end edge of the fattener tape in the longitudinal direction. It is therefore possible to increase strength with which the box pin and the box body are attached to the fastener tape using the bulged portion.

EMBODIMENTS OF INVENTION

Hereinafter, a concealed slide fastener according to an embodiment of the present invention will be described in detail with reference to the accompanying drawings. In the following description, as for the fastener tape, a front side refers to a near side with respect to the paper surface of FIG. 1, a back side refers to a far side with respect to the paper surface of FIG. 1, and a direction perpendicular to the plane of the fastener tape may be referred to as a front-back direction. An upper side refers to an upper side with respect to the paper surface of FIG. 1, a lower side refers to a lower side with respect to the paper surface of FIG. 1, a left side refers to a left side with respect to the paper surface of FIG. 1, and a right side refers to a right side with respect to the paper surface of FIG. 1. As for the slider, an upper side refers to a near side with respect to the paper surface of FIG. 1 (a side in which a pull-tab which will be described later is provided), a lower side refers to a far side with respect to the paper surface of FIG. 1, a front side refers to an upper side with respect to the paper surface of FIG. 1, a rear side refers to a lower side with respect to the paper surface of FIG. 1, a left side refers to a left side with respect to the paper surface of FIG. 1, and a right side refers to a right side with respect to the paper surface of FIG. 1. In addition, the left and right direction of the fastener tape and the slider is also referred to as a width direction. In addition, an up-down direction is also referred to as a longitudinal direction of the fastener tape. The width direction is also a direction that is parallel to the plane of the fastener tape and perpendicular to the longitudinal direction. When moving the slider in the up-down direction, movement in the upward direction causes disengaged fastener element rows to be engaged with each other, and movement in the downward direction causes the engaged fastener element rows to be disengaged from each other.

Figure 1:
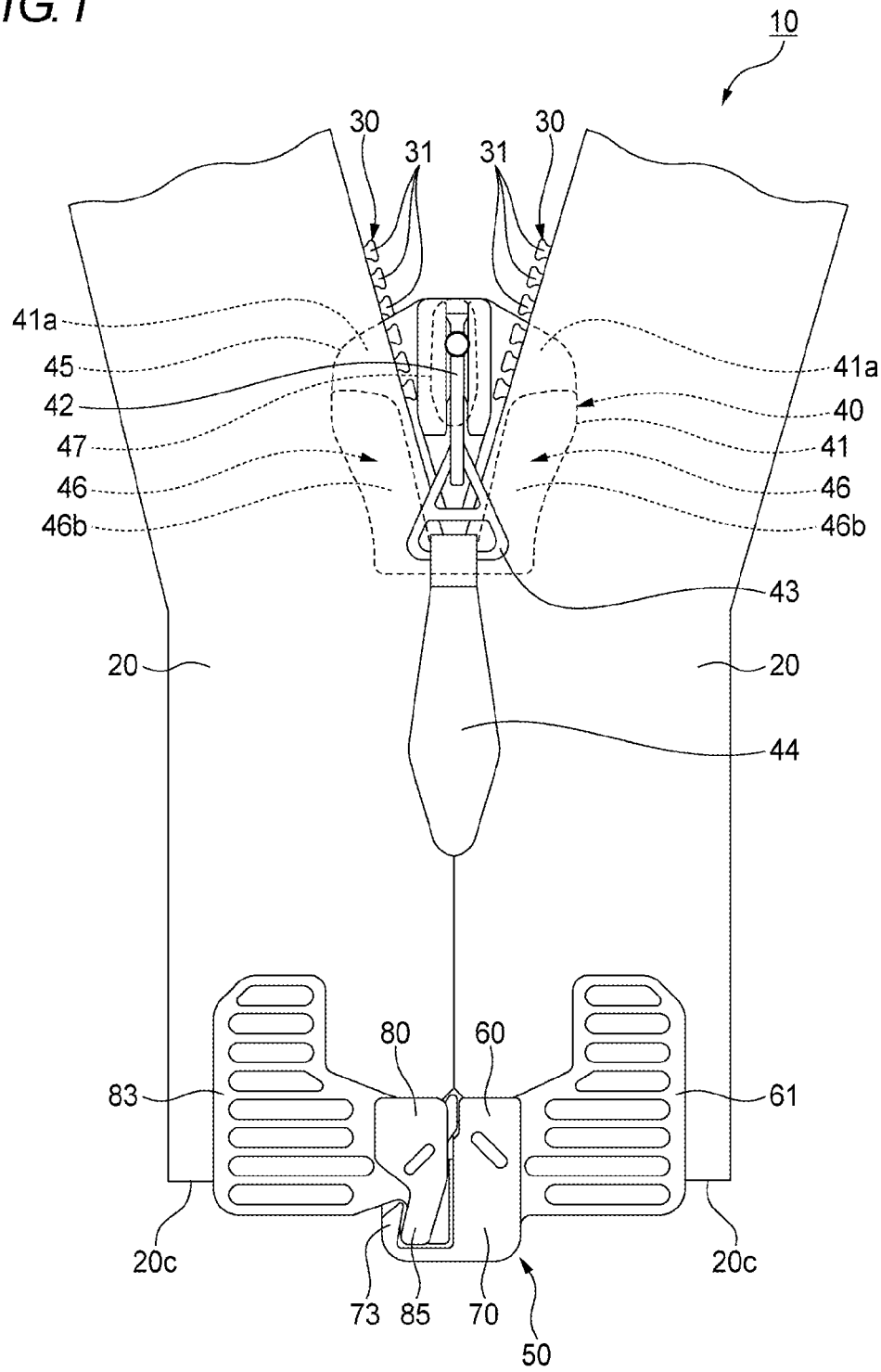
FIG. 1 is a front view depicting an embodiment of a concealed slide fastener according to the present invention.
Figure 2:
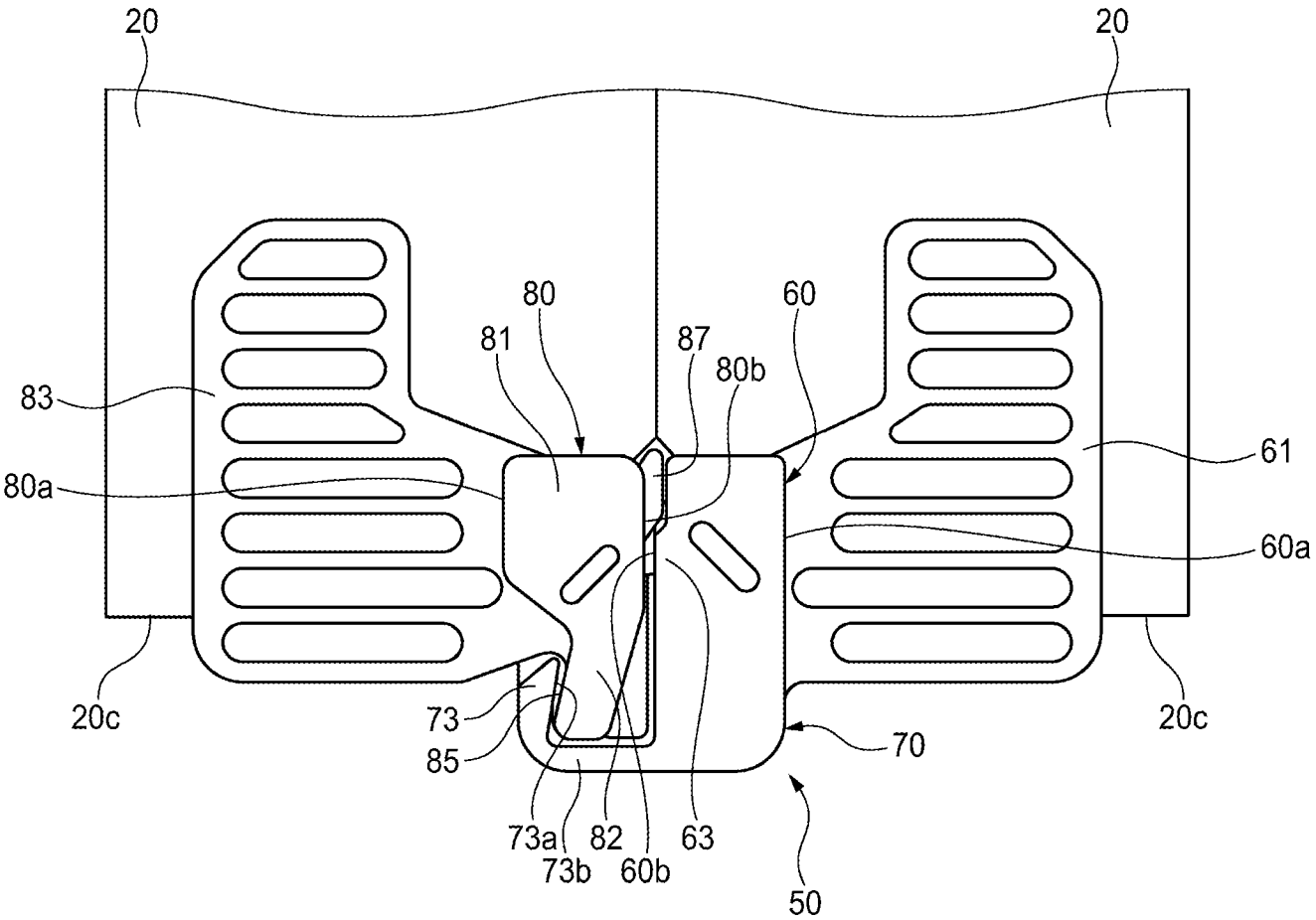
FIG. 2 is an enlarged front view of the surroundings of the separable end stop shown in FIG. 1.
Figure 6:
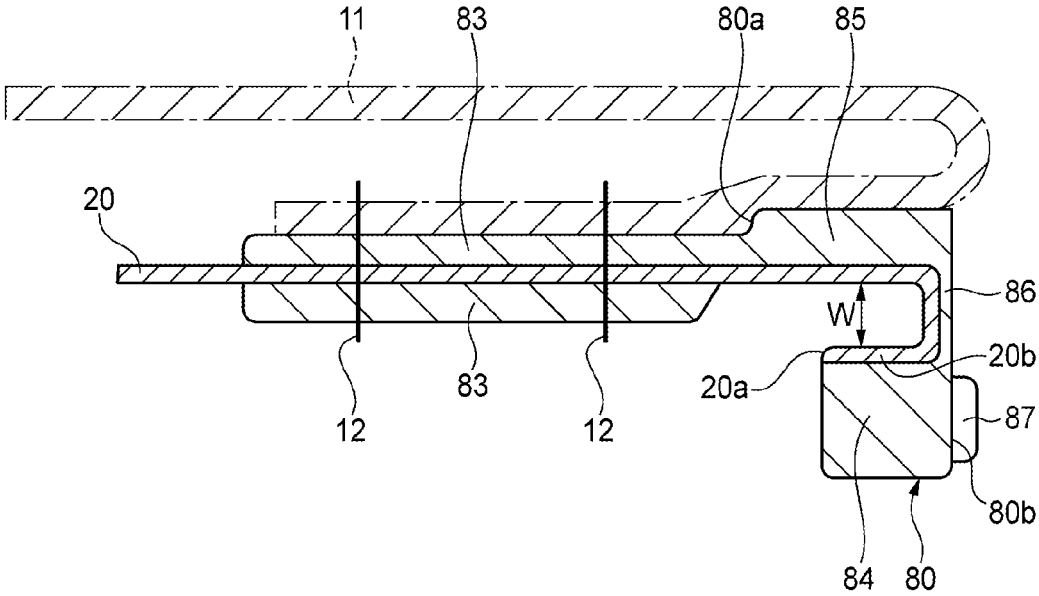
FIG. 6 is a cross-sectional view taken along line A-A in FIG. 4.

As shown in FIG. 1 and FIG. 6, a concealed slide fastener 10 according to this embodiment includes a pair of left and right fastener tapes 20, a pair of left and right fastener element rows 30 and a slider 40. The pair of left and right fastener element rows 30 are respectively sewn to bent edges 20*b* which are formed by bending opposing tape side edges 20*a* of the pair of left and right fastener tapes 20 along the longitudinal direction thereof into substantially U-shape. The slider 40 is configured to insert the pair of left and right fastener element rows 30 therethrough and configured to engage and disengage the fastener element rows 30 with and from each other. By sliding the slider 40 forwards and backwards, the fastener element rows 30 are engaged with and disengaged from each other. In FIG. 6, reference numeral 11 indicates a piece of cloth of a garment, that is bent into substantially U-shape, to which the concealed slide fastener 10 is attached and reference numeral 12 indicates sewing threads for attaching the concealed slide fastener to the garment 11.

Figure 3:
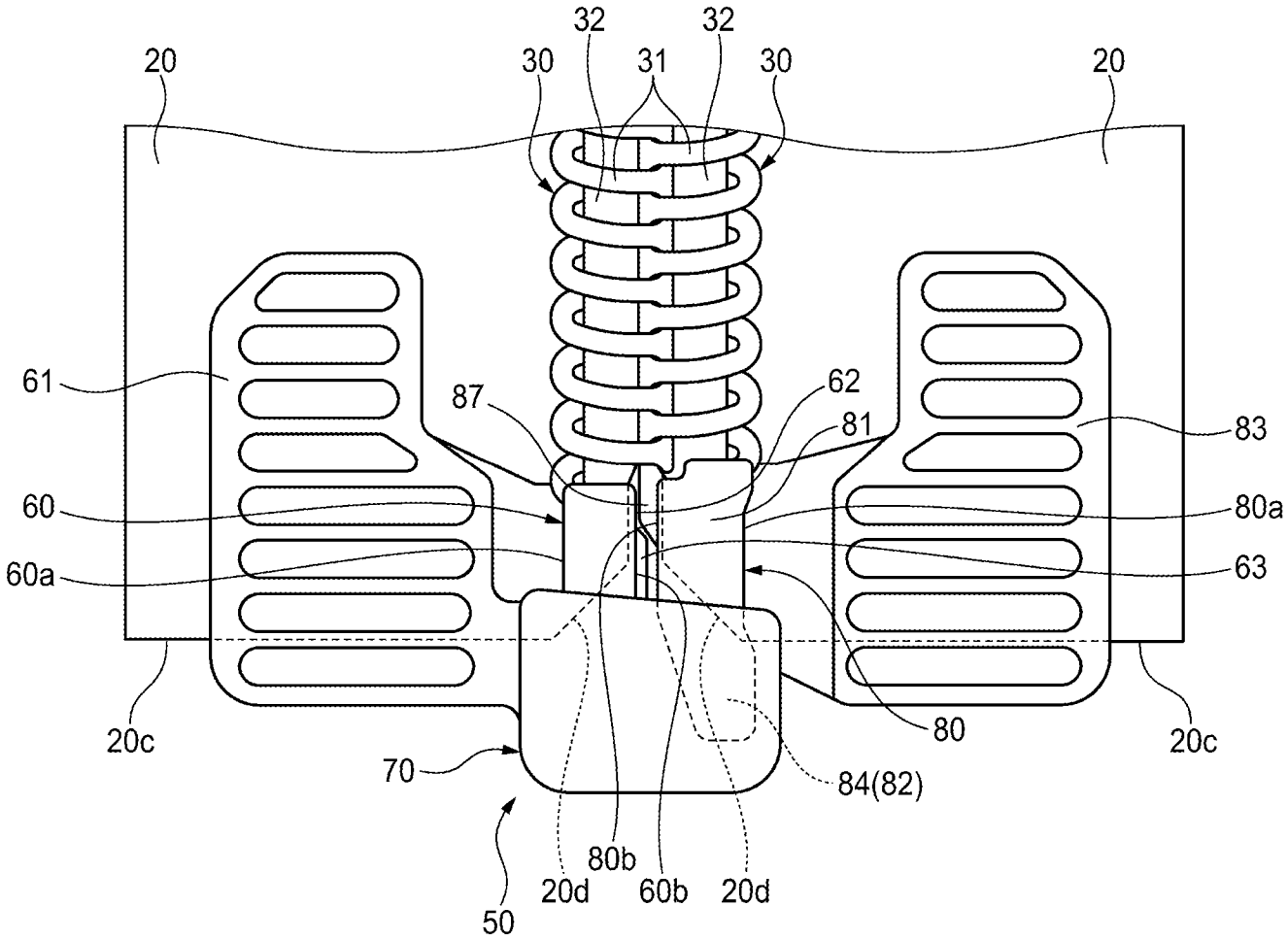
FIG. 3 is an enlarged rear view of the surroundings of the separable end stop shown in FIG. 1.
Figure 5:
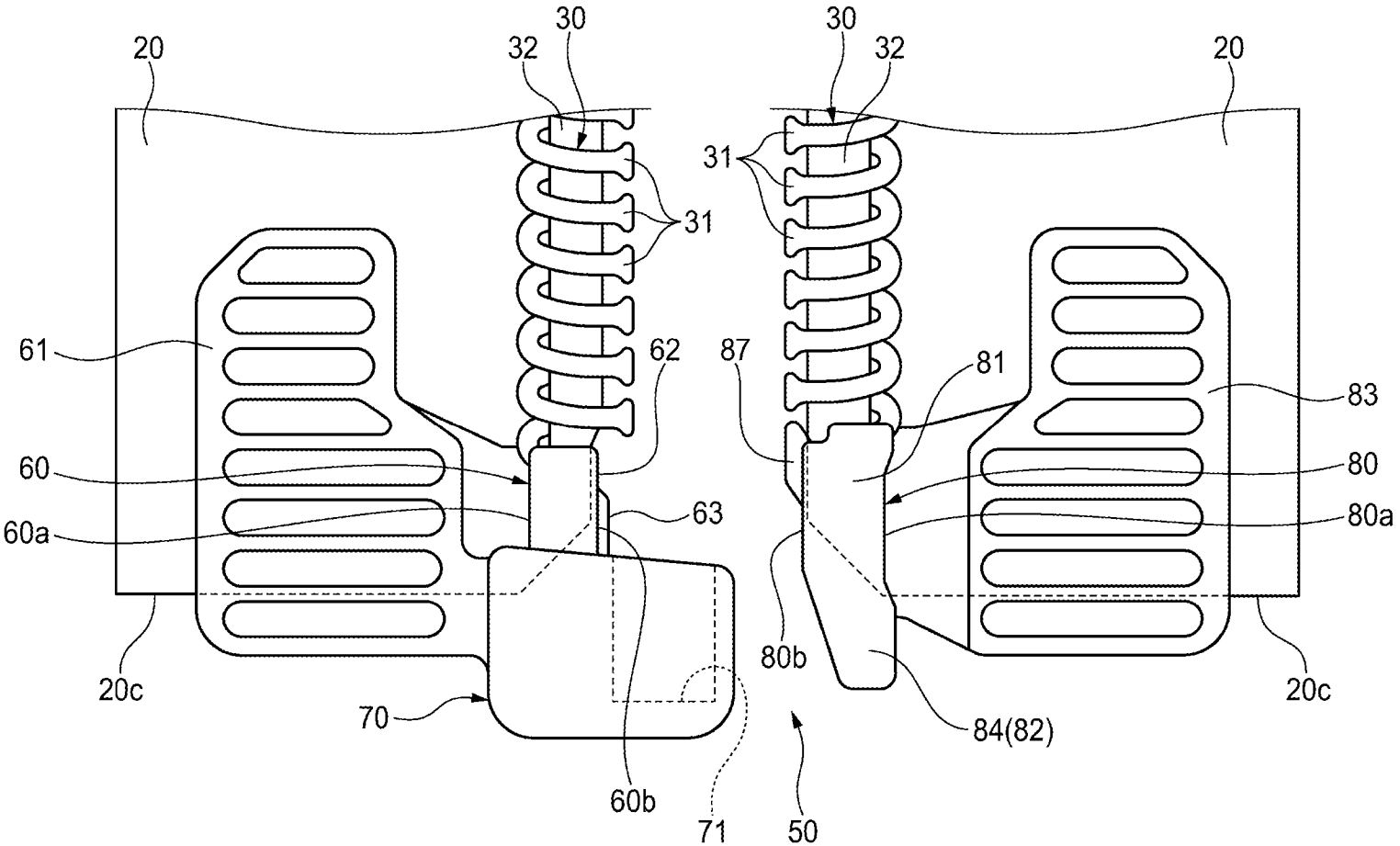
FIG. 5 is an enlarged rear view of the separable end stop shown in FIG. 2 in the separated state.

As shown in FIG. 3 and FIG. 5, each fastener element row 30 is a coil-shaped fastener element row which is formed by winding mono-filaments made of synthetic resin in a predetermined direction. Each fastener element row 30 includes a plurality of fastener elements 31. A core string 32 is inserted into each fastener element row 30 so as to pass through each fastener element row 30. The fastener element rows 30 are sewn to the bent edges 20*b* of the fastener tapes 20 by using sewing threads (not shown) which is sewn with double chain stitch sewing. In order to facilitate the understanding of the figures, the sewing threads are omitted in this embodiment. Each fastener element 31 has an engagement head 31*a*, a pair of legs and a connecting portion to form a plurality of continuous fastener elements in a row. The engagement head 31*a* is configured to be engaged with and disengaged from the counterpart fastener element 31. The pair of legs extend in one direction from the engagement head 31*a*. The connecting portion connects legs of adjacent elements. In addition, in the sewn state, the engagement heads 31*a* of the fastener elements 31 protrude outwardly from the bent edges 20*b*. In addition, in the fastener engagement row 30, the mono-filament made of synthetic resin may be formed into a zigzag shape and be sewn to the bent edge 20*b*.

The slider 40 is a slider with an automatic stop function. As shown in FIG. 1 and FIG. 11 to FIG. 13, the slider 40 includes a body 41, a stop claw member 42, a damper 43, a pull-tab 44, and a spring (not shown).

The body 41 has a lower blade 45 and a pair of left and right flanges 46. The pair of left and right flanges 46 have a pair of left and right side wall portions 46*a* and a pair of left and right upper plate portions 46*b*. The pair of left and right sidewall portions 46*a* are erected along the left and right side edges of the lower blade 45. The pair of left and right upper plate portions 46*b* extend from the upper ends of the pair of sidewall portions 46*a* in a mutually approaching direction. Each of the pair of left and right flanges 46 has an inverted L-shaped cross section. In addition, a guide post 47 is erected from the left and right center of the front part of the lower blade 45, between the left and right upper plate portions 46*b*. The guide post 47 pivotally supports the stop claw member 42. In addition, left and right shoulder mouths 41*a* which are divided by the guide post 47 are formed on the front part of the body 41, and a rear mouth 41*b* is formed in the rear part of the body 41. Moreover, a guide passage 48 having a substantially Y-shape is formed between the lower blade 45 and the pair of left and right upper plat portions 46*b*. The guide passage 48 connects the left and right shoulder mouths 41*a* and the rear mouth 41*b*. The pair of left and right fastener element rows 30 slidably pass through the element guide passage 48.

As shown in FIG. 1 to FIG. 10, the concealed slide fastener 10 is provided with a separable end stop 50 at the lower end of the pair of left and right fastener tapes 20. The separable end stop 50 has a box pin 60, a box body 70 and an insert pin 80. The box pin 60 and the box body 70 are provided at the lower end of the fastener element row 30 of the right fastener tape 20 in the longitudinal direction. The insert pin 80 is provided at the lower end of the fastener element row 30 of the left fastener tape 20 in the longitudinal direction. The insert pin 80 is insertable into the box body 70. The box pin 60, the box body 70 and the insert pin 80 are formed on the lower ends of the pair of left and right fastener tapes 20 by injection molding with thermoplastic resin such as polyamide, polyacetal, polypropylene, polybutyleneterephthalate, or the like. In addition, a top end stop for preventing the slider 40 from being dislodged is formed on the upper end.

The box pin 60 is a substantially angular column-shaped member, which is formed in the state in which the box pin 60 abuts the fastener element row 30 of the right fastener tape 20 and protrudes from a lower edge 20*c* of the fastener tape 20 in the longitudinal direction of the tape. In addition, a reinforcing portion 61 having the shape of a transverse lattice is provided on the front and back surfaces of the tape body 20*c* at one side of the right fastener tape 20, the one side to which the fastener element row 30 is not attached. The reinforcing portion 61 is configured to reinforce an end portion of the fastener tape 20 to which the box pin 60 is attached. The reinforcing portion 61 integrally extends from an outer side surface 60*a* of the box pin 60 at one side away from the insert pin 80, toward the outside in the width direction (in a direction away from the insert pin 80). The reinforcing portion 61 extends upward on the box pin 60 so as to further strengthen reinforcement of the end portion of the fastener tape 20.

The box body 70 is a box-shaped member that is integrally molded on the lower portion of the box pin 60. The box body 70 has an insert pin-receiving space 71 in the left half portion thereof. The insert pin-receiving space 71 opens upward so that the insert pin 80 can be inserted inside the insert pin-receiving space 71. Wall portions that define the insert pin-receiving space 71 therein include a partition 72 which is disposed in the front surface side. The partition 72 has a notch portion 72*a* which continues from the upper end to the lower end of the partition 72 while defining a required width. The notch portion 72*a* is disposed between the partition 72 and a side surface (inner surface) 60*b* of the box pin 60, which faces the insert pin 80. The width of the notch portion 72*a* is set to a size that is greater than the plate thickness of a sidewall portion 86 of the insert pin 80 which will be described later.

In addition, a locked portion 73 is integrally formed on a wall surface of the partition 72, opposite to the insert pin-receiving space 71 such that the locked portion 73 protrudes to the front side. The locked portion 73 has an erected portion 73*a* and a horizontal portion 73*b* which are engaged with an engagement portion 85 of the insert pin 80 which will be described later. The erected portion 73*a* is formed so as to be obliquely erected upward from the horizontal portion 73*b*.

The insert pin 80 has a base 81 and an insert pin body 82. The base 81 is formed at a lower end portion of the fastener tape 20 so as to abut the fastener element row 30 of the left fastener tape 20 and protrude from the lower edge 20*c* of the fastener tape 20 in the longitudinal direction of the tape. The insert pin body 82 extends downward from the base 81, and is formed so as to have a substantially U-shaped cross-section conforming to the bent shape of the bent edge 20*b* of the fastener tape 20. In addition, a reinforcing portion 83 having the shape of a transverse lattice is provided on the front and back surfaces of the tape body 20*c* of the left fastener tape 20. The reinforcing portion 83 is configured to reinforce an end portion of the fastener tape 20 to which the insert pin 80 is attached. The reinforcing portion 83 integrally extends from an outer side surface 80*a* of the insert pin 80, at one side away from the box pin 60, toward the outside in the width direction (in a direction away from the box pin 60). The reinforcing portion 83 extends upward on the insert pin 80 so as to further strengthen reinforcement of the end portion of the fastener tape 20.

Figure 4:
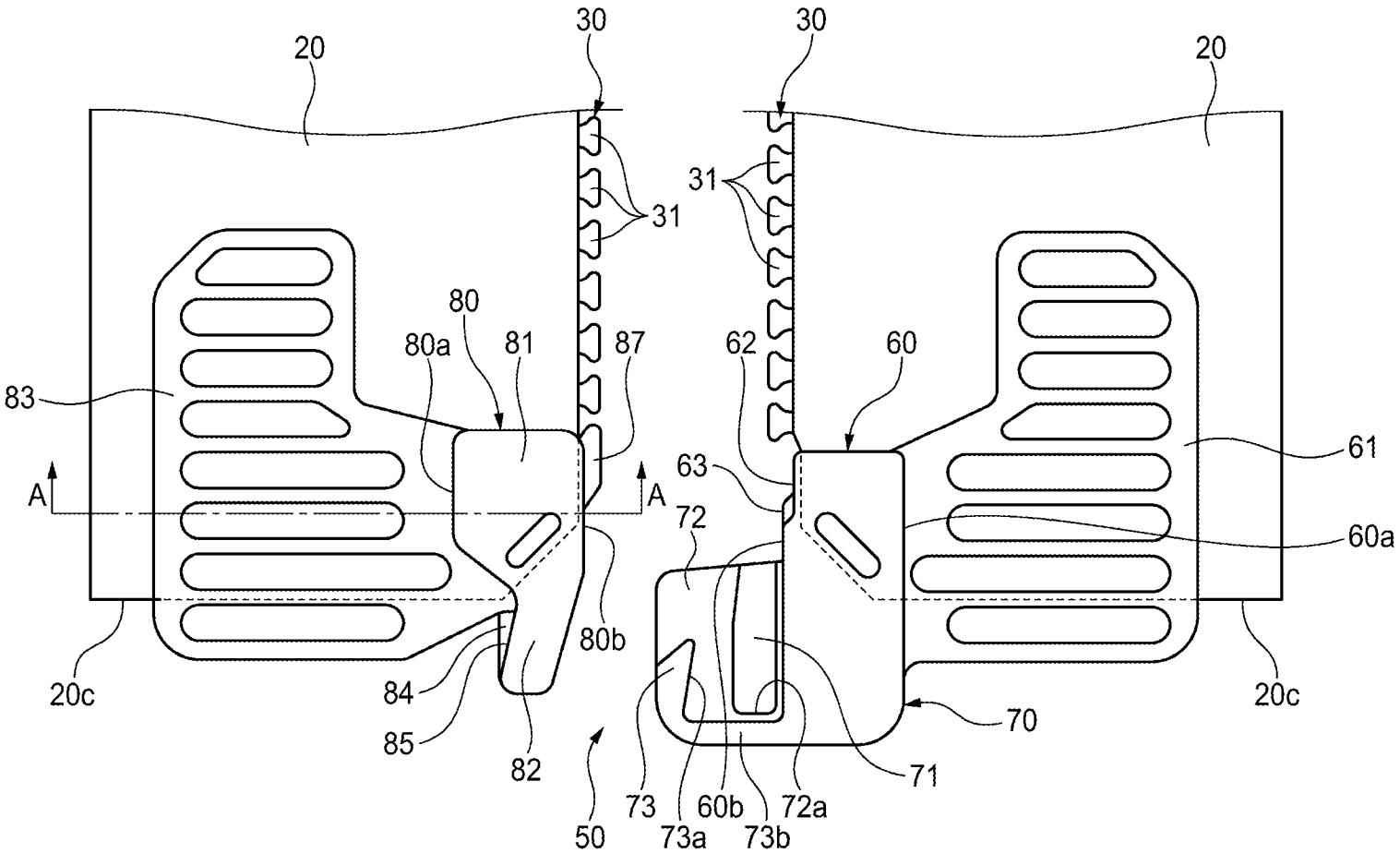
FIG. 4 is an enlarged front view of the separable end stop shown in FIG. 2 in the separated state.

As shown in FIG. 4 to FIG. 6, the insert pin body 82 has an insert portion 84, an engagement portion 85, and a sidewall portion 86. The insert portion 84 is configured to be inserted into the insert pin-receiving space 71 of the box body 70. The engagement portion 85 is configured to be engaged with the locked portion 73 of the box body 70. The sidewall portion 86 connects the insert portion 84 and the engagement portion 85 in the front-back direction. The sidewall portion 86 is configured to be inserted into the notch portion 72*a* of the box body 70. In addition, the distance W between the inner surface of the insert portion 84 and the inner surface of the engagement portion 85 is set to a size such that the partition 72 of the box body 70 can be interposed between the insert portion 84 and the engagement portion 85 when the insert portion 84 is inserted into the insert pin-receiving space 71. In addition, the engagement portion 85 is engaged with the locked portion 73 in response to the erected portion 73*a* of the locking portion 73 abutting the side surface of the engagement portion 85, at a side away from the box pin 60. The erected portion of the locked portion 73 may be perpendicular to the horizontal portion 73*b* as long as the erected portion of the locked portion 73 can be engaged with the engagement portion 85.

Figure 8:
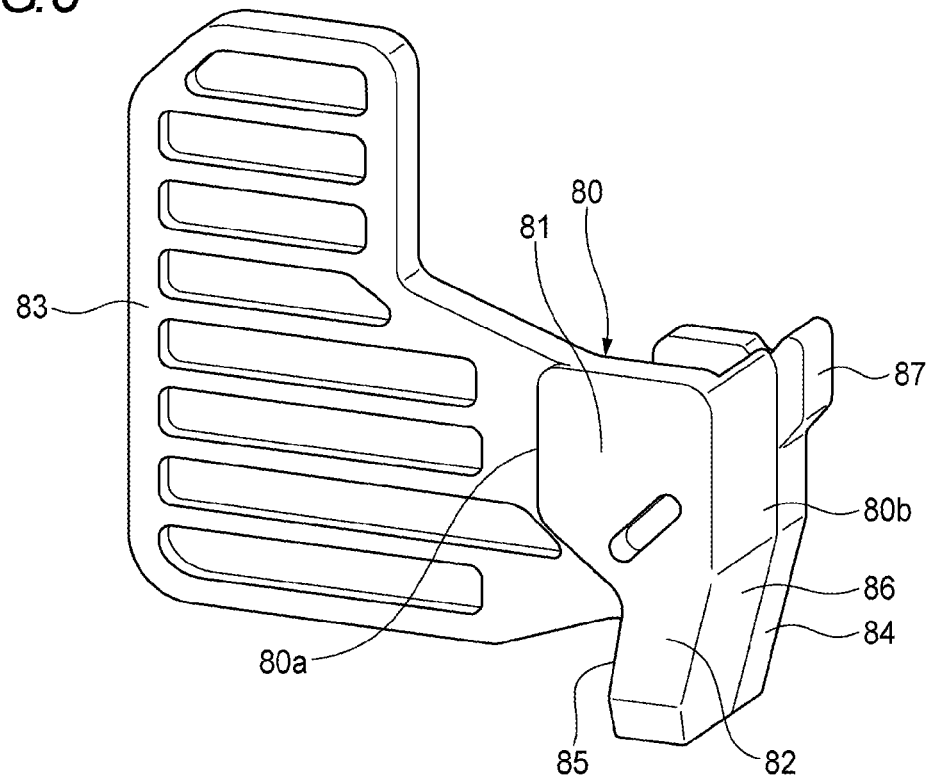
FIG. 8 is a perspective view of the insert pin shown in FIG. 4.
Figure 10:
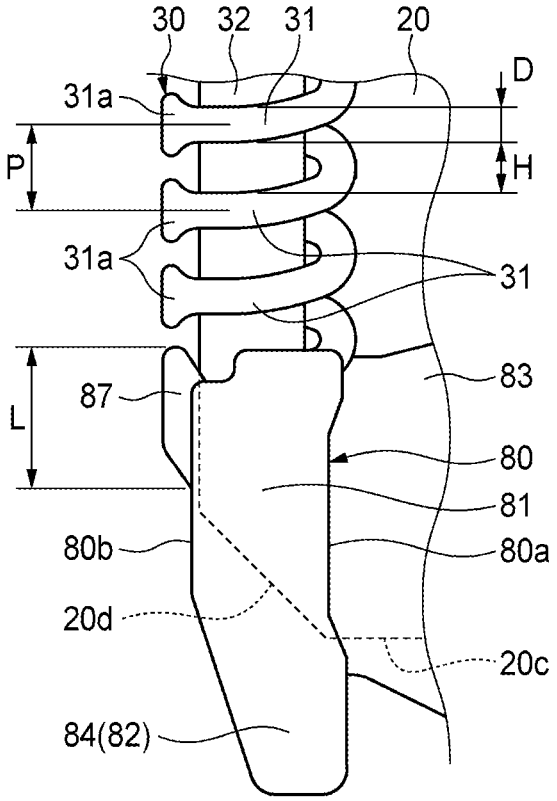
FIG. 10 is an enlarged rear view of the surroundings of the insert pin shown in FIG. 5.

As shown in FIG. 4, FIG. 8 and FIG. 10, an engagement portion 87 is formed on the side surface (inner surface) 80*b* of the insert portion 84 of the insert pin 80, which faces the box pin 60, at a side close to the fastener element row 30. The engagement portion 87 is configured to be engaged with the lowermost one of the fastener elements 31 of the fastener element row 30 which is close to the box pin 60. The length L of the engagement portion 87 in the up-down direction is set to be at least twice the interval H between the fastener elements 31. The engagement portion 87, at a side close to the fastener element row 30, protrudes upward from the side surface 80*b* of the insert portion 84 in a tapered shape. The engagement portion 87 is engaged with the engagement head 31*a* of the lowermost fastener element 31 of the fastener element row 30 which is close to the box pin 60. The length L of the engagement portion 87 is a dimension between a leading end to be engaged and a base end at which the engagement portion 87 protrudes from the side surface 80*b* of the insert pin 80 in the width direction. The interval H can be obtained by subtracting a value twice a radius D/2 of a wire diameter D of the fastener element 31 from a pitch P which is an interval between the centers of the engagement heads 31*a* and 31*a* of adjacent fastener elements 31 and 31 in the longitudinal direction of the fastener tape 20.

Figure 7:
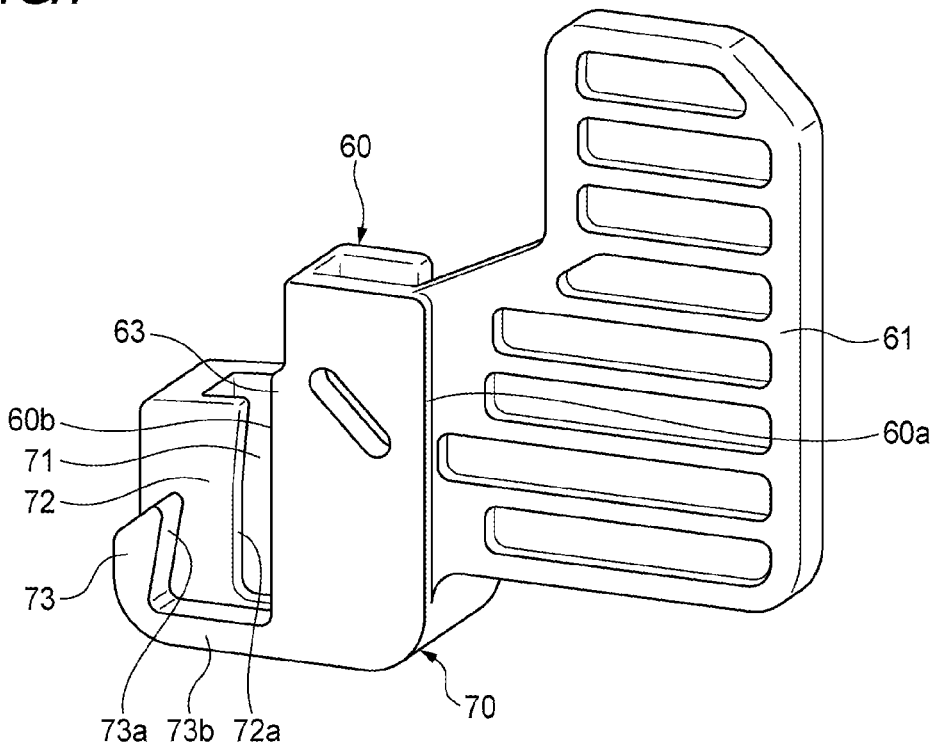
FIG. 7 is a perspective view of the box pin and the box body shown in FIG. 4.
Figure 9:
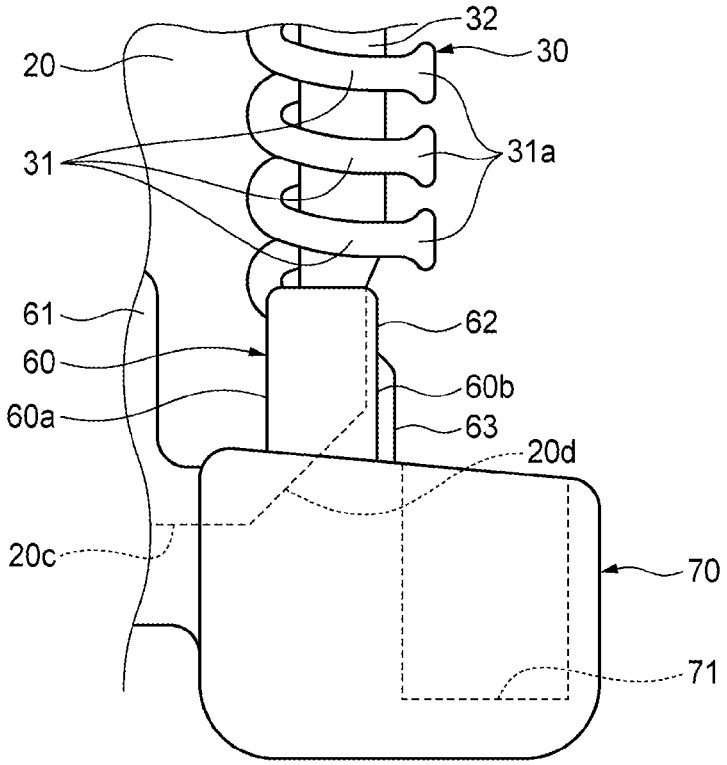
FIG. 9 is an enlarged rear view of the surroundings of the box pin and the box body shown in FIG. 5.

As shown in FIG. 4, FIG. 7 and FIG. 9, a receiving portion 62 which is configured to receive the engagement portion 87 of the insert pin 80 therein is formed in the side surface (inner surface) 60*b* of the box pin 60. A bulged portion 63 is formed on the box pin 60 at a position closer to the box body 70 than the receiving portion 62 of the box pin 60. The bulged portion 63 has a dimension greater than a dimension of the portion of the box pin 60, at which the receiving portion 62 is formed in the width direction. The base end of the bulged portion 63 is positioned closer to the fastener element 31 than the lower edge 20*c* of the fastener tape 20. Here, the lower edge 20*c* of the fastener tape 20 is an edge in the longitudinal direction, and is cut in the width direction with respect to the up-down direction (longitudinal direction) on the horizontal surface of the fastener tape 20. For example, the lower edge 20*c* may be cut perpendicular to the up-down direction, or be cut obliquely, as will be described later. The position of the lower edge 20*c* of the fastener tape 20 at a side close to the tape side edges 20*a* is below the base end of the bulged portion 63. Consequently, the box pin 60 can be strongly attached to the fastener tape 20. Since the edge of the fastener tape 20 become difficult to be exposed to the side surface 60*b* of the box pin 60, the edge of the fastener tape 20 does not interfere with the insert pin 80 when inserting the insert pin 80.

As shown in FIG. 9 and FIG. 10, an inclined portion 20*d* is formed on a corner section of the lower edge 20*c* of the fastener tape 20 at a side close to the fastener element row 30. The inclined portion 20*d* is formed by oblique cutting the corner section. Consequently, it is possible to prevent the fastener tape 20 from being exposed to the insert pin-receiving space 71 of the box body 70, which would otherwise make it difficult to insert the insert pin 80 into the insert pin-receiving space 71. Although the corner section of the lower edge 20*c* of the fastener tape 20 is obliquely cut in this embodiment, it may be cut into an arc shape.

Figure 11:
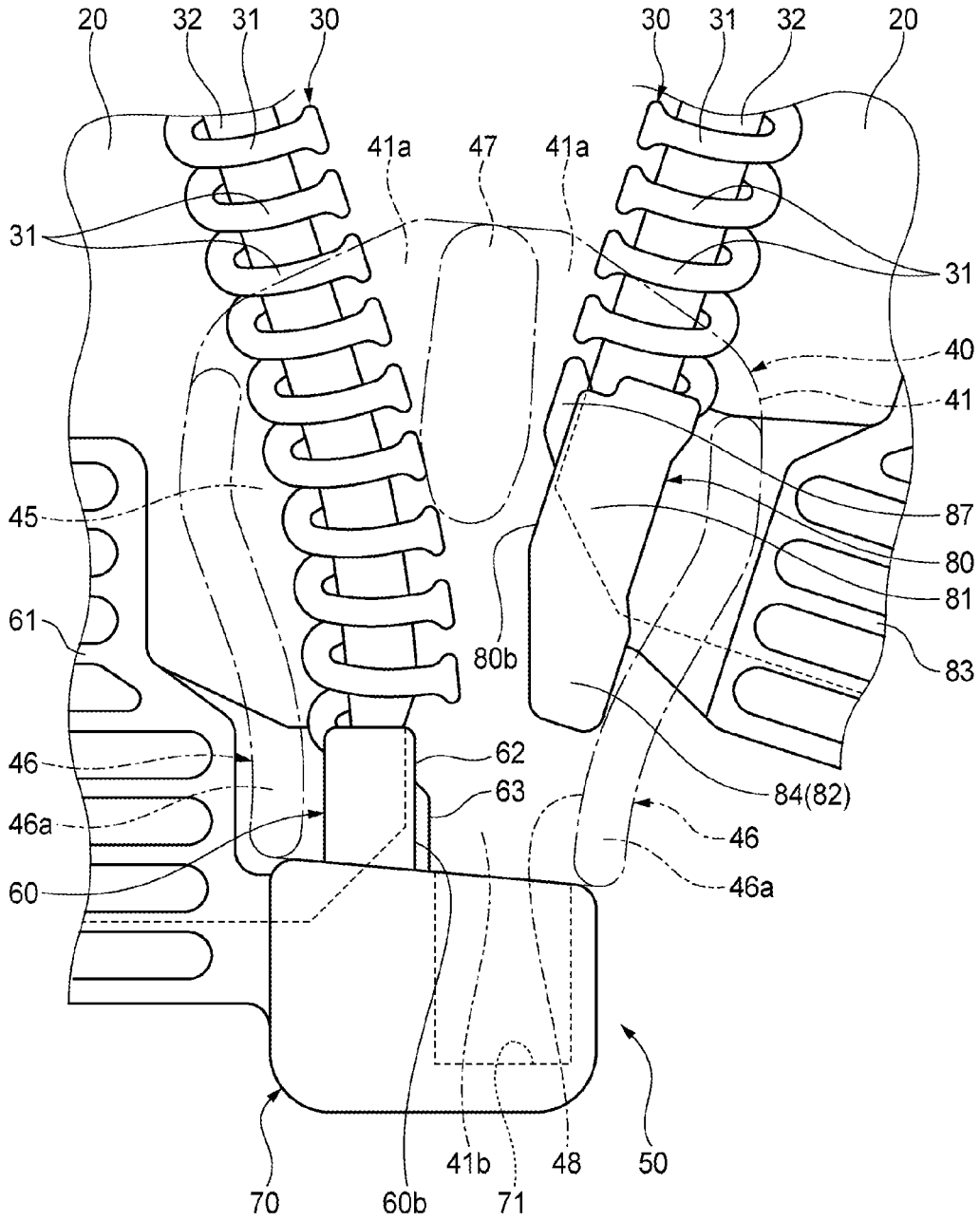
FIG. 11 is an enlarged rear view showing a state in which the insert pin is inserted into the slider.
Figure 12:
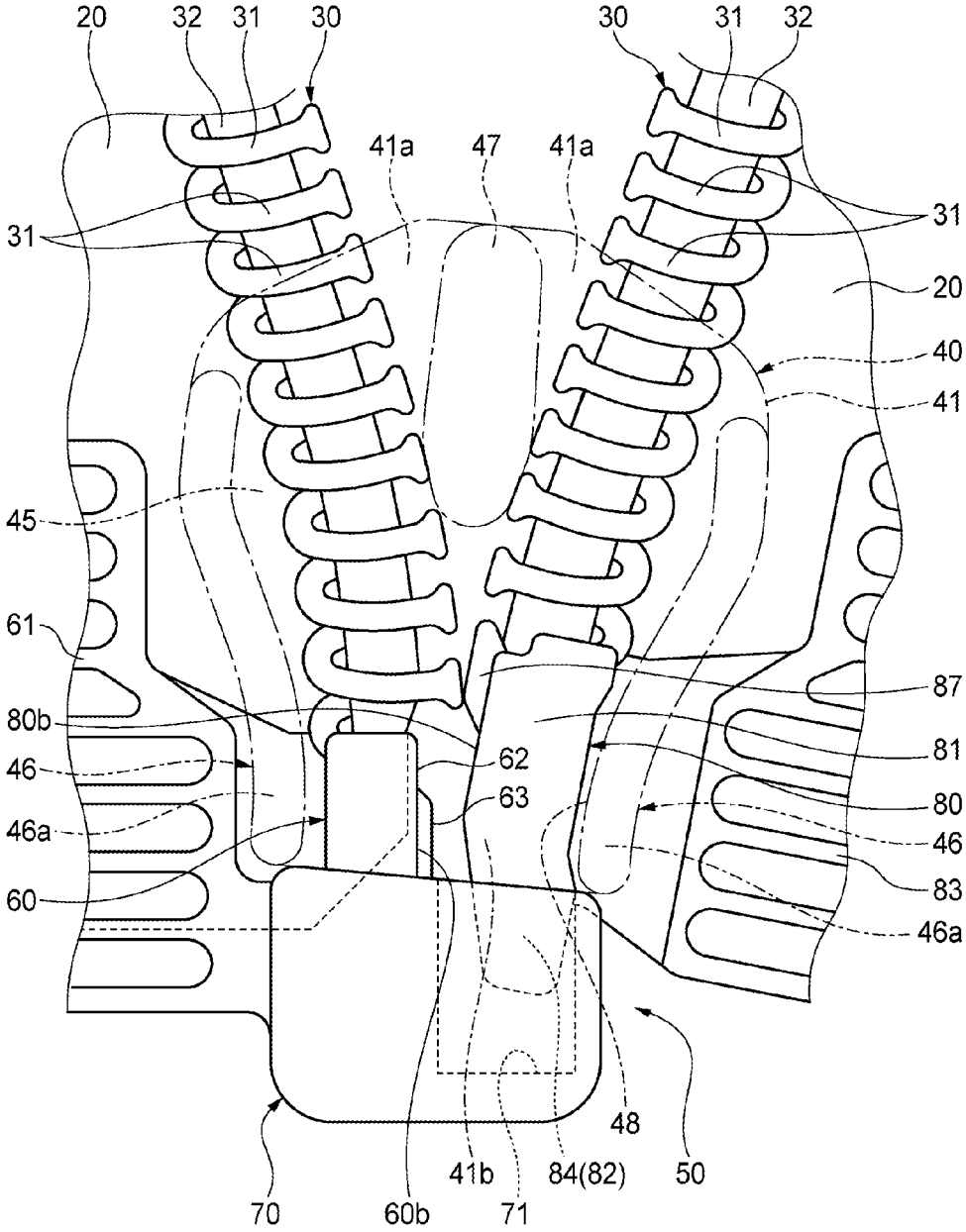
FIG. 12 is an enlarged rear view showing a state in which the insert pin is inserted into the box body.
Figure 13:
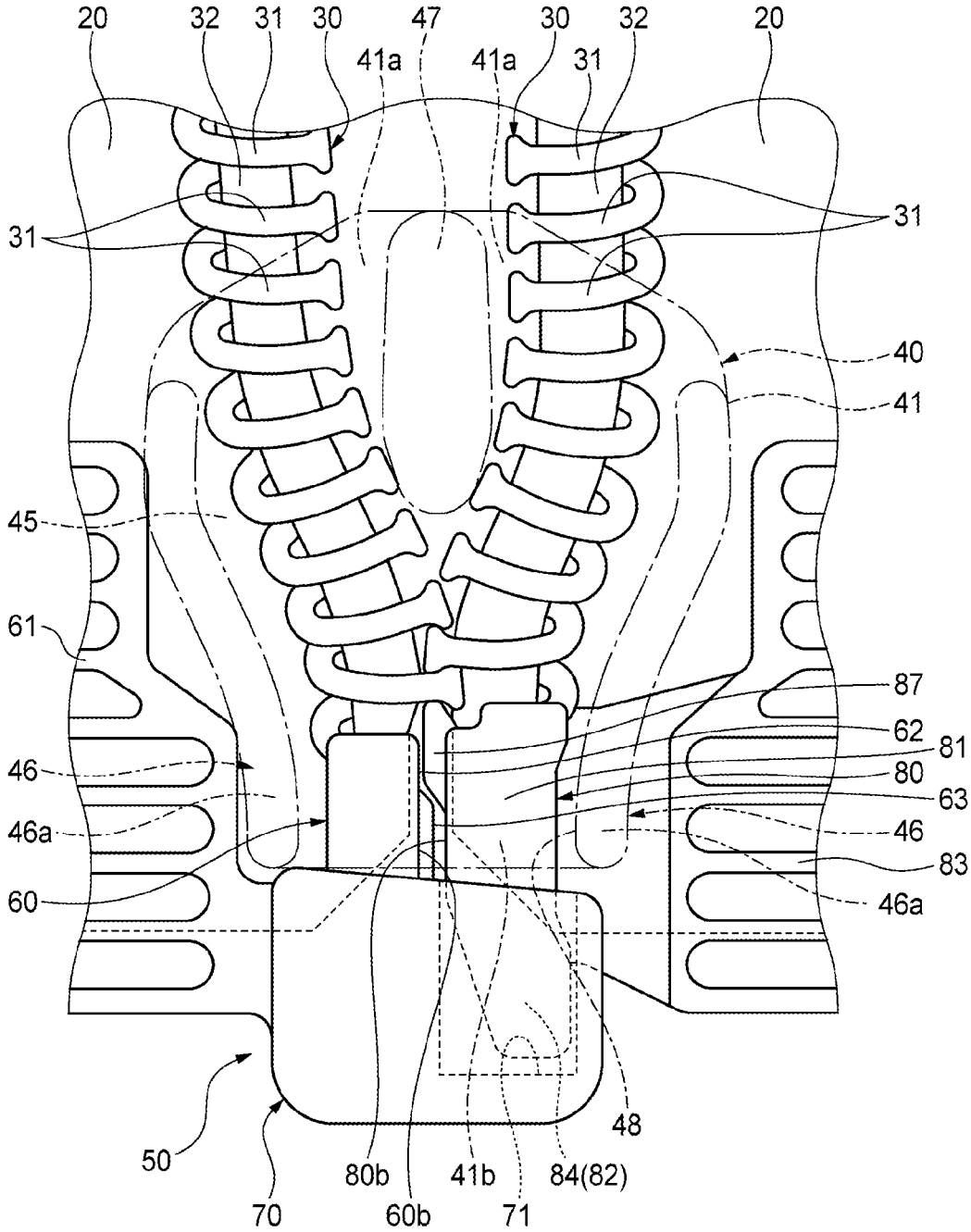
FIG. 13 is an enlarged rear view showing a state in which the insert pin is inserted into a predetermined position of the box body.
Figure 14:
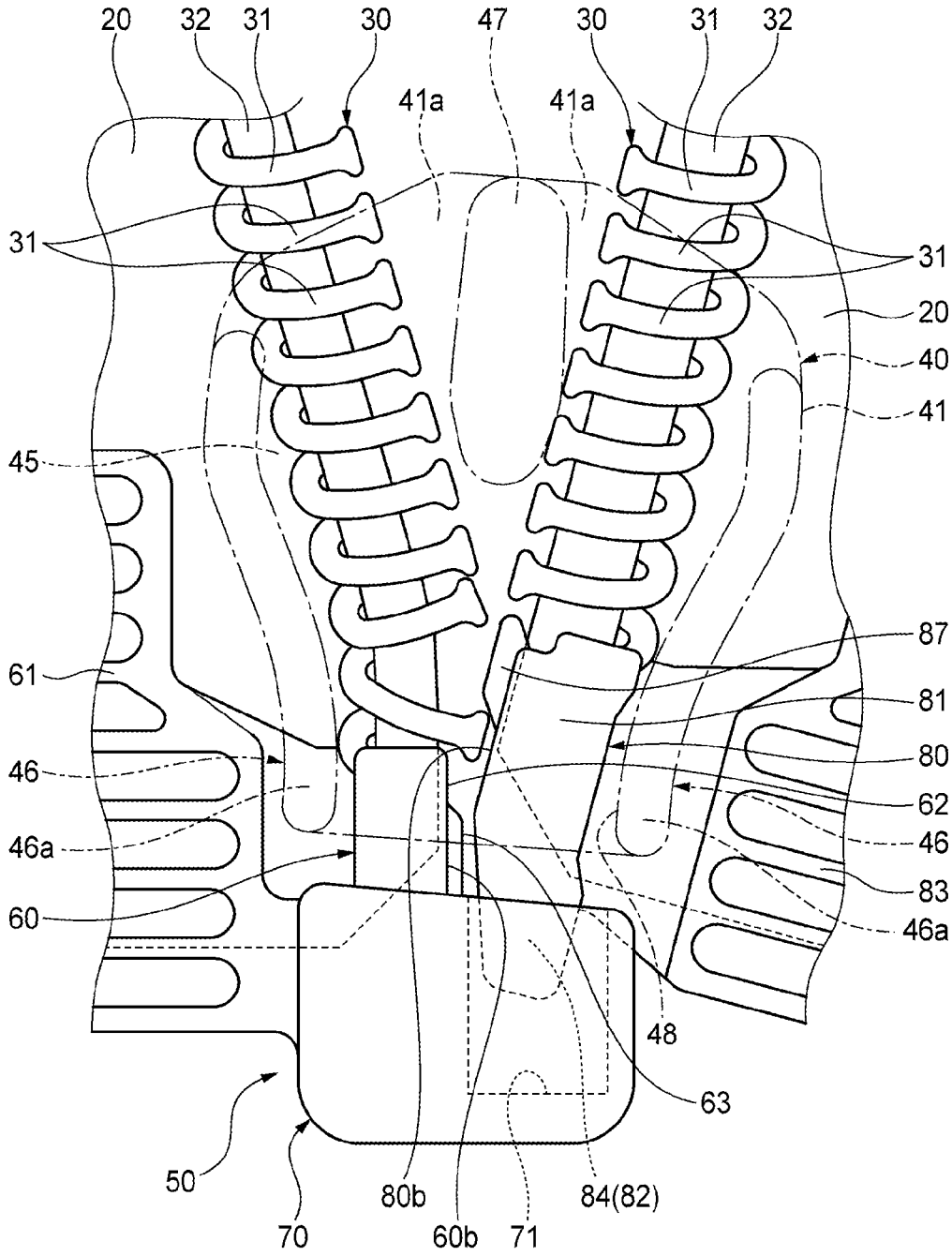
FIG. 14 is an enlarged rear view showing a state in which the slider is moved in the closing direction without inserting the insert pin into a predetermined position of the box body.

In the concealed slide fastener 10 configured as above, the insert pin 80 does not enter between the plurality of fastener elements 31, as shown in FIG. 11 to FIG. 13. It is therefore possible to smoothly insert the insert pin 80 into a predetermined position of the insert pin-receiving space 71 of the box body 70. FIG. 14 shows a view when the slider 40 is about to move upward in a state where the insert portion 84 of the insert pin 80 is incompletely inserted into the insert pin-receiving space 71 of the box body 70 (a state where the insert portion 84 is not inserted to a predetermined position). Even if the space between the plurality of fastener elements 31 (for example, the space between the lowermost fastener element 31 which is close to the box pin 60 and the adjacent fastener element 31 in the figure) is opened to the maximum, the engagement portion 87 does not enter between the fastener elements 31. Therefore, the unintended engagement between the plurality of fastener elements 31 and the engagement portion 87 is reliably prevented. In addition, when the space is opened to the maximum, the interval therebetween is smaller than twice the interval H. As shown in FIG. 14, the base end side of the engagement portion 87 is formed as an inclined surface such that the dimension thereof in the width direction gradually decreases toward the lower side, and the angle thereof is in the range from 30° to 60°, and preferably 45°. With this inclined surface and the length L, it is possible to prevent the engagement head 31*a* of the fastener element 31 which is opened to the maximum from abutting the inclined surface and being caught by the engagement portion 87. In addition, the base end of the bulged portion 63 of the box pin 60 is formed so as to conform to the inclined surface of the base end of the engagement portion 87. This increases the area that is to be attached to the fastener tape 20, thereby increasing attachment strength.

As described above, according to the concealed slide fastener 10 of this embodiment, the insert pin 80 includes the insert portion 84 which is configured to be inserted into the insert pin-receiving space 71 of the box body 70 and the engagement portion 87 which is formed on the side surface (inner surface) 60*b* of the insert portion 84, which faces the box pin 60. The engagement portion 87 is configured to be engaged with the lowermost fastener element 31 of the fastener element row 30 which is close to the box pin 60. The length L of the engagement portion 87 is set to be at least twice the interval H between adjacent two fastener elements 31. Even if the slider 40 is about to move in the closing direction in a state where the insert pin 80 is not inserted into the predetermined position, the engagement portion 87 does not enter between the fastener elements 31. Therefore, it is possible to prevent the slider 40 from moving in the closing direction. Accordingly, it is possible to prevent the undesirable engagement of the fastener elements 31, thereby improving the reliability of the concealed slide fastener 10.

In addition, according to the concealed slide fastener 10 of this embodiment, the base end of the bulged portion 63 is positioned closer to the fastener element 31 than the lower edge 20*c* of the fattener tape 20. It is therefore possible to increase attachment strength with which the box pin 60 and the box body 70 are attached to the fastener tape 20 using the bulged portion 63.

Figure 15:
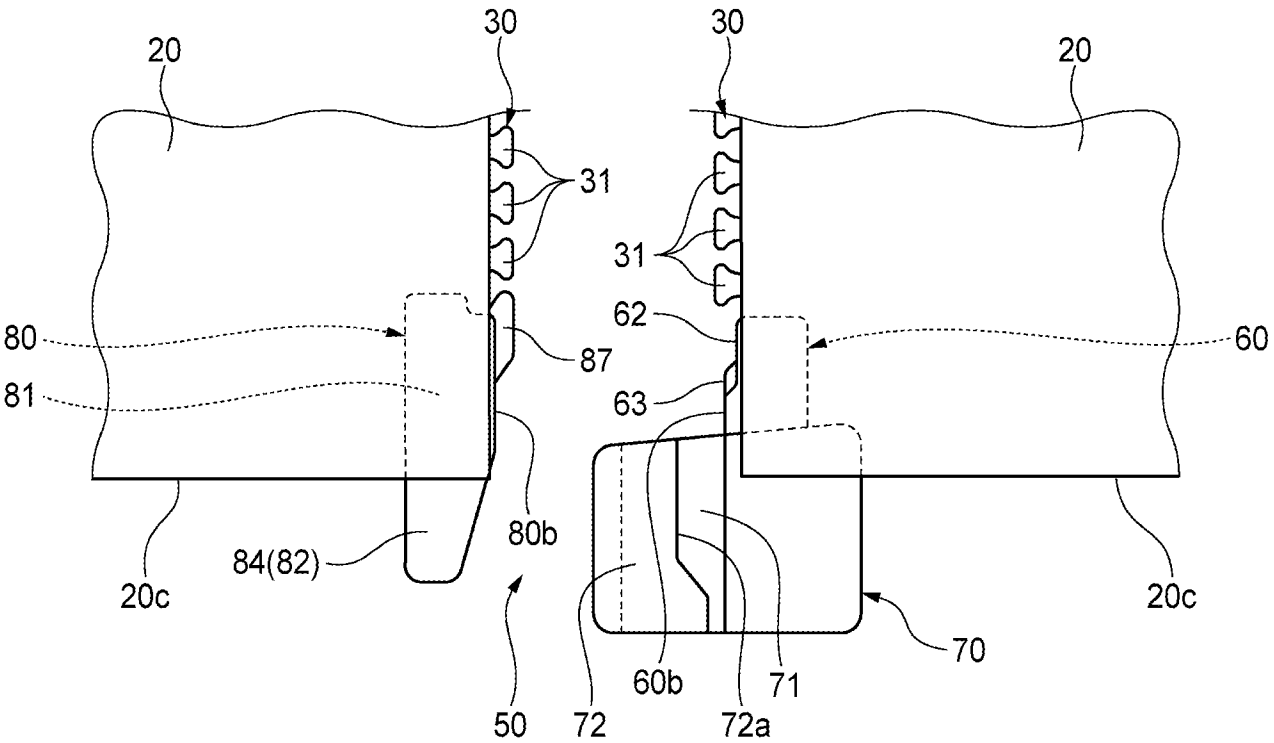
FIG. 15 is an enlarged front view of a separable end stop in a modified example of an embodiment of the concealed slide fastener according to the present invention in a separated state.
Figure 16:
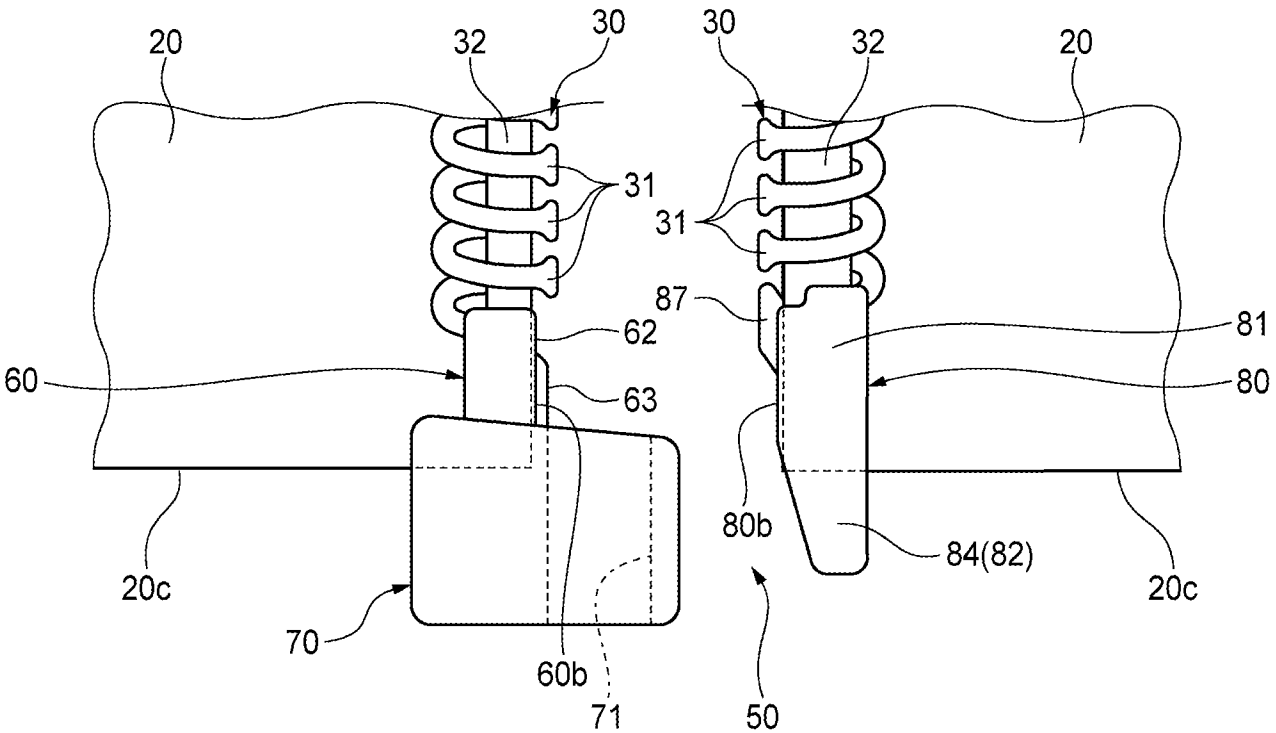
FIG. 16 is an enlarged rear view of the separable end stop of the modified example shown in FIG. 15 in the separated state.

As a modified embodiment of this embodiment, as shown in FIG. 15 and FIG. 16, the reinforcing portion 61 and the locked portion 73 may be removed from the box pin 60 and the box body 70, and the reinforcing portion 83 and the engagement portion 85 may be removed from the insert pin 80. In this modified embodiment, the box pin 60 and the insert pin 80 are formed on the bent edge 20*b* of the fastener tape 20, and the lower end of the fastener tape 20 is linearly cut in the width direction.

The present invention is not limited to the above-illustrated embodiments, but may be properly changed without departing from the concept of the invention.

In an example, although the box body and the box pin are integrally molded in the embodiments of the invention, the invention is not limited thereto. Rather, it is possible to integrally mold a box pin and an insert pin on the lower end of a pair of left and right fastener tapes, mold a box body which has a box pin-receiving space and an insert pin-receiving space as a separate body from the box pin, and then insert the box pin into the box pin-receiving space of the box body, such that the box pin is fixedly engaged with an engagement portion (not shown) in the box pin-receiving space.

In addition, in the above-described embodiment and modified embodiment, as shown in FIG. 6, the engagement portion 87 of the insert pin 80 is formed so as to be positioned on a far side (a side opposite the front side) of the bent edge 20*b* of the fastener tape 20, and the fastener element row 30 is attached at the same position. Therefore, the tape side edge 20*a* of the fastener tape 20, which is bent into the U-shape is positioned in front of the engagement portion 87.

DESCRIPTION OF REFERENCE NUMERALS

10 Concealed Slide Fastener
20 Fastener Tape
20*a* Tape Side Edge
20*b* Bent Edge

20*c* Lower Edge
30 Fastener Element Row
31 Fastener Element
40 Slider
50 Separable End Stop
60 Box Pin
60*b* Side Surface (Inner Surface)
62 Receiving Portion
63 Bulged Portion
70 Box Body
71 Insert Pin-Receiving Space
80 Insert Pin
80*b* Side Surface (Inner Surface)
84 Insert Portion
87 Engagement Portion
L Length of Engagement Portion
H Interval between Fastener Elements

The invention claimed is:

1. A concealed slide fastener comprising:

a pair of fastener tapes;

a pair of fastener element rows respectively provided on bent edges which are formed by bending opposing tape side edges of the pair of fastener tapes along a longitudinal direction thereof into substantially U-shape, the pair of fastener element rows each having a plurality of continuous fastener elements;

a slider configured to insert the pair of fastener element rows therethrough and configured to engage and disengage the pair of fastener element rows with and from each other;

a box pin and a box body which are provided at one end of one of the pair of fastener tapes in a longitudinal direction of the pair of fastener element rows; and an insert pin provided at one end of another of the pair of fastener tapes in the longitudinal direction of the pair of fastener element rows, the insert pin being insertable into the box body, wherein the insert pin comprises:

an insert portion configured to be inserted into a space formed in the box body; and an engagement portion formed on a side surface of the insert portion, which faces the box pin and configured to be engaged with a lowermost one of the fastener elements of one of the fastener element rows which is close to the box pin, and wherein a length of the engagement portion in the longitudinal direction of the pair of fastener element rows is set to be at least twice an interval between a first fastener element and a second fastener element adjacent to the first fastener element of one of the fastener element rows in the longitudinal direction of the pair of fastener element rows, wherein the interval is defined between a lower edge of the first fastener element and an upper edge of the second fastener element.

2. The concealed slide fastener according to claim 1, wherein a receiving portion configured to receive the engagement portion therein is formed in a side surface of the box pin, which faces the insert pin, wherein a bulged portion having a dimension greater than a dimension of a portion of the box pin, at which the receiving portion is formed, in a width direction is formed on the box pin at a position closer to the box body than the receiving portion, and wherein a base end of the bulged portion is positioned closer to the fastener elements than an end edge of the pair of fastener tapes in a longitudinal direction.

3. The concealed slide fastener according to claim 1, wherein the insert pin further comprises:

a second engagement portion configured to be engaged with a locked portion of the box body; and a sidewall portion connecting the insert portion and the second engagement portion in a front-back direction of the pair of fastener tapes, wherein the engagement portion having a leading end to be engaged with the lowermost one of the fastener elements and a base end at which the engagement portion protrudes from the side surface of the insert portion in a width direction of the pair of fastener tapes and the length of the engagement portion is a dimension between the leading end and the base end, and wherein a part of the engagement portion at a side of the base end thereof is formed with an inclined surface which is inclined such that a dimension of the engagement portion in the width direction gradually decreases toward a leading end of the insert pin.

* * * * *

UNITED STATES PATENT AND TRADEMARK OFFICE

CERTIFICATE OF CORRECTION

PATENT NO. : 8,782,859 B2
APPLICATION NO. : 13/695117
DATED : July 22, 2014
INVENTOR(S) : Go Takani It is certified that error appears in the above-identified patent and that said Letters Patent is hereby corrected as shown below:

In the Specification

In column 4, line 58, delete “damper” and insert -- clamper --, therefor.

Signed and Sealed this
Fourteenth Day of October, 2014

Michelle K. Lee

Michelle K. Lee
*Deputy Director of the United States Patent and Trademark Office*